US005697438A

United States Patent [19]

Rehbock et al.

[11] Patent Number: 5,697,438

[45] Date of Patent: Dec. 16, 1997

[54] TORQUE CONTROL DEVICE FOR DOWNHOLE MILLING

[75] Inventors: Hans H. Rehbock, Houston; Edgar D. Lueders, Stafford; Wayne M. Biart, Houston, all of Tex.

[73] Assignee: Baker Hughes Incorporated, Houston, Tex.

[21] Appl. No.: 566,026

[22] Filed: Dec. 1, 1995

[51] Int. Cl.[6] ..... F21B 7/08

[52] U.S. Cl. ..... 166/55.7; 166/117.5

[58] Field of Search ..... 166/55.1, 55.7, 166/117.5, 117.6; 175/80, 81

[56] References Cited

U.S. PATENT DOCUMENTS

| | | | |
|---|---|---|---|
| 3,339,636 | 9/1967 | Frisby | 166/117.5 |
| 4,153,109 | 5/1979 | Szescile | 166/250 |
| 4,665,995 | 5/1987 | Braithwaite et al. | 166/117.5 X |
| 4,765,404 | 8/1988 | Bailey et al. | 166/117.6 |
| 5,109,924 | 5/1992 | Jurgens et al. . | |
| 5,193,620 | 3/1993 | Braddick | 166/382 |
| 5,287,921 | 2/1994 | Blount et al. | 166/117.6 |
| 5,311,936 | 5/1994 | McNair et al. | 166/50 |
| 5,335,737 | 8/1994 | Baugh | 175/61 |
| 5,341,873 | 8/1994 | Carter et al. . | |
| 5,437,340 | 8/1995 | Lee et al. | 175/61 |
| 5,443,129 | 8/1995 | Bailey et al. | 175/45 |

FOREIGN PATENT DOCUMENTS

| | | |
|---|---|---|
| 3832715 A1 | 3/1990 | Germany . |
| 2299106 | 9/1996 | United Kingdom . |
| WO96/09460 | 3/1996 | WIPO . |

OTHER PUBLICATIONS

R. Steven, AZ International Packstock Complete with Starter Mill, Running Tool and Bypass Valve, drawing No. AZ0015, Aug. 27, 1992.

A–Z International Tool Co., A–Z Pack–Stock Casing Sidetracking System, Composite Catalog, 1 page.

A–Z Grant International literature, Casing Sidetrack Systems, 7 pages.

*Primary Examiner*—William P. Neuder
*Attorney, Agent, or Firm*—Rosenblatt & Redano, P.C.

[57] ABSTRACT

A support mechanism for a mill, particularly usable with a whipstock and driven by a downhole motor supported by coiled tubing is disclosed. The support mechanism comprises a wearable ring adjacent the cutting structure which, when assembled into the downhole assembly, keeps the rotating blades away from the whipstock face and oriented toward the casing to be cut. As the milling progresses, the support mechanism wears away to allow advancement of the mill into the casing to complete the formation of the window or opening.

20 Claims, 1 Drawing Sheet

TORQUE CONTROL DEVICE FOR DOWNHOLE MILLING

FIELD OF THE INVENTION

The field of this invention relates to milling casing downhole, particularly milling a window using a whipstock in combination with a milling tool run on coiled tubing.

BACKGROUND OF THE INVENTION

Frequently in downhole operations, an existing wellbore may need to be extended in a deviated manner. Alternatively, even in drilling of a new well, deviations are required to obtain optimum production from the formation. Typically, in order to create such deviated wellbores in a cased opening, a whipstock, which is generally known in the field as a deviation device, is used to direct a mill laterally into the casing for cutting a hole so that the deviated portion of the wellbore can be drilled. Such mills for cutting windows or openings in casing are known and have been employed in a variety of styles to accommodate the window-cutting operation. The mill can be run on rigid tubing or on flexible coiled tubing.

One of the problems encountered in running such mills in combination with whipstocks, particularly with the coiled tubing application, has been that the mill undesirably contacts the whipstock and at times can wedge itself between the still-to-be-cut casing and the whipstock, thereby causing a stall condition in a downhole motor which is driving that mill. Additionally, as the mill comes up to speed and pressure is increased in the coiled tubing to the downhole motor, the coiled tubing tends to elongate or stretch. This may undesirably advance the mill closer to the wedge point between the still-to-be-cut casing and the whipstock, again causing a stall condition. Additionally, contact between the mill and the whipstock causes undesirable damage to the whipstock. Furthermore, the repeated cycling of starting and stopping due to stall conditions makes the cutting structure on the mill wear much more quickly than if there were to continue to be a steady cutting operation.

Accordingly, it is an object of the present invention to reduce stalling in mills that are operated through coiled tubing in combination with a downhole motor. It is another objective to prolong the life of the mill and shorten the time necessary to cut the window by giving the mill proper support during the cutting so that it does not encounter the whipstock in a manner which will damage it, thus reducing the tendency to stall due to jamming.

U.S. Pat. No. 5,341,873 illustrates whipstocks and how they can be used downhole and ultimately retrieved. U.S. Pat. No. 5,109,924 illustrates generally the use of a mill or mills to cut a window in a casing.

SUMMARY OF THE INVENTION

A support mechanism for a mill, particularly usable with a whipstock and driven by a downhole motor supported by coiled tubing is disclosed. The support mechanism comprises a wearable ring adjacent the cutting structure which, when assembled into the downhole assembly, keeps the rotating blades away from the whipstock face and oriented toward the casing to be cut. As the milling progresses, the support mechanism wears away to allow advancement of the mill into the casing to complete the formation of the window or opening.

DETAILED DESCRIPTION OF THE PREFERRED EMBODIMENT

Figure 1:
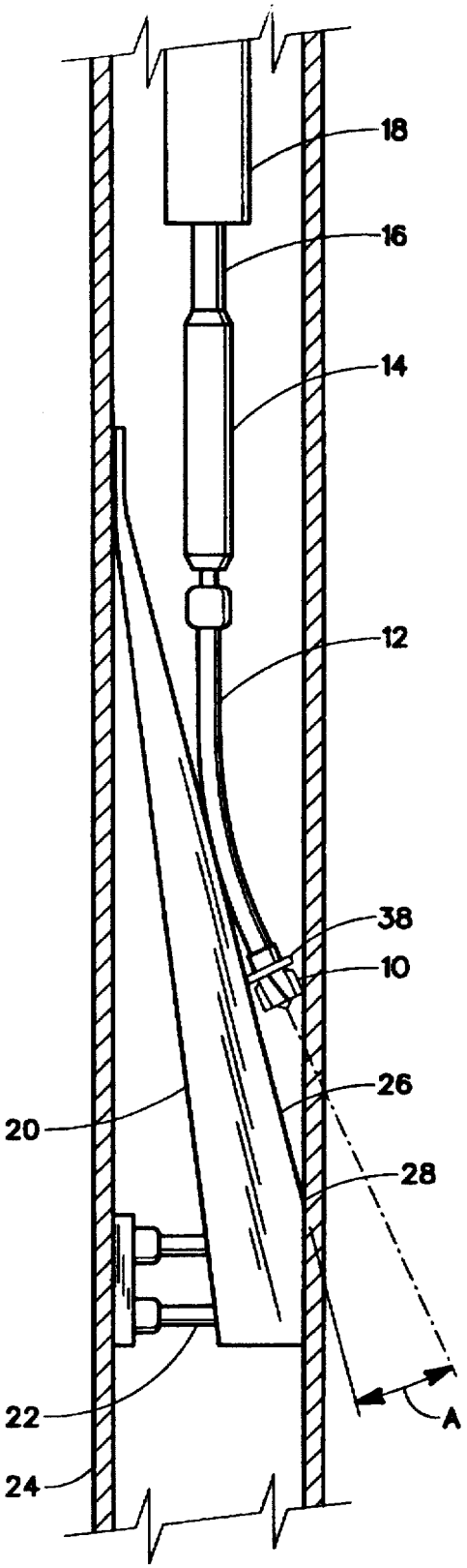
FIG. 1 is a sectional elevational view showing a mill in conjunction with a whipstock and locating the wearable ring of the present invention.

FIG. 1 illustrates a typical downhole assembly involving a mill 10. The mill 10 is shown in more detail in FIG. 2. A flexible joint 12 supports the mill 10 and is the link between the mill 10 and the mud motor 14. The mud motor 14 is connected to coiled tubing 16, which is inserted from the surface through a tubing string, the lower portion of which is illustrated at 18. Also shown in FIG. 1 is a whipstock 20, which is supported by an anchor 22 in a known manner.

The whipstock 20 is situated and properly oriented within the casing 24. The purpose of the mill 10 is to mill an opening through the casing 24.

As shown in FIG. 1, the whipstock 20 has a guiding surface 26, which defines a taper which approaches a pinch point 28. Well before pinch point 28, the clearance between the guiding surface 26 and the casing 24 becomes sufficiently small enough such that the mill 10 can bog down if the coiled tubing 16 stretches under load.

Figure 2:
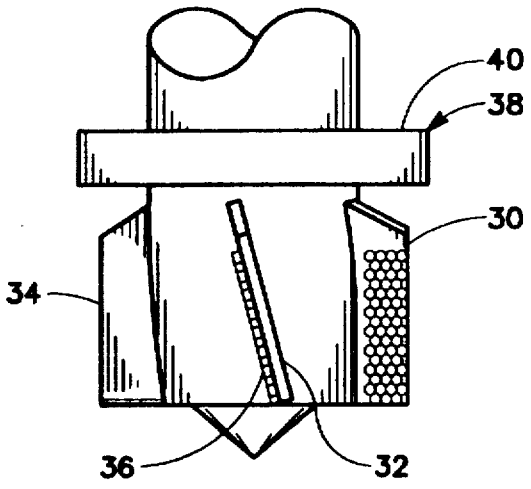
FIG. 2 is a close-up of the wearable ring, showing its placement adjacent the cutting structure of the mill.

FIG. 2 illustrates a close-up view of a mill structure illustrating a plurality of blades 30–34. The blades may be inclined as shown in blade 32, with a leading surface having a plurality of tungsten carbide inserts 36, preferably arranged in rows and columns as indicated generally in U.S. Pat. No. 4,796,709 (fully incorporated by reference herein), but other arrangements are within the purview of the invention.

However, the invention is applicable to many different types of mills used in conjunction with whipstocks. Referring again to FIG. 2, a wearable ring 38 is disposed above the blades 30–34. While the FIG. 2 shows three blades, it is within the purview of this invention to use the wearable ring for a wide variety of different mills which can be used in conjunction with whipstocks such as 20. The wearable ring can be made of brass or any other type of wearable material. It should preferably be placed in close proximity to the cutting structure of the mill. In the preferred embodiment, the initial diameter of the wearable ring, as indicated by 40, extends radially outwardly further than the blades 30–34. Because the ring 38 extends further outwardly radially, it serves to protect the cutting structure of the tool as it is tripped downhole through the tubing 18.

The procedure is to place the mill 10 on the guiding surface 26 of the whipstock 20. The assembled components above the ring 38 have a sufficient length and weight so as to give the cutting structure 30–34 of the mill 10 an orientation toward the wall of the casing 24, as shown in FIG. 1. In essence, the ring 38 becomes a fulcrum with the overwhelming weight comprising of the flex joint 12 and the mud motor 14 bearing down and moving toward the guiding surface 26 of whipstock 20. As a result, rotation occurs about the ring 38, putting the cutting structure of the mill 10, which includes blades 30–34, in an angled orientation represented by angle A on FIG. 1. Since the mill 10 has the orientation as shown in FIG. 1 due to the ring 38, the motor 14 can then be brought up to optimum speed and torque without the mill 10 cutting into or hanging up on the whipstock surface 26.

The ring 38, acting as a fulcrum, helps to keep the cutting blades 30–34 away from the guiding surface 26 of the whipstock 20, while at the same time forcing the cutting blades 30–34 toward or against the casing 24 so that the opening is initially cut in the casing 24 as desired, as opposed to the guiding surface 26 of the whipstock 20, which would be undesirable.

Those skilled in the art will appreciate that the mill 10 can only advance or bite into the casing 24 at the rate at which the ring 38 is radially worn away. This phenomenon limits the penetration of the cutting elements, such as blades 30–34, into the casing wall 24. In essence, the ring 38 prevents the mill 10 from approaching too close to the pinch point 28 where stalling can occur upon elongation during normal operation of the coiled tubing 16. The ring 38 can be worn by rubbing against the guiding surface 26, as well as the inner wall of the casing 24. It is because ring 38 initially rubs against these surfaces that its advance is limited toward the pinch point 28, thus minimizing stalling when mill 10 first comes to speed and as it cuts through casing 24.

Eventually, the ring 38 wears down to where it no longer extends beyond the outer periphery of the blades 30–34, thus permitting the mill 10 to further advance fully into the opening that has already been started from the onset of the milling activity.

Those skilled in the art will appreciate that what has been disclosed is a simple system to shorten the time for drilling an opening in a casing 24, as well as to prolong the useful life of mills such as 10. One of the main advantages of the invention, apart from its simplicity, is that it adjusts to the operating conditions downhole. It acts not only as a fulcrum to direct the cutting structure away from the whipstock 20, but it also limits the rate of penetration into the casing wall until ring 38 has sufficiently worn down. By the time the ring 38 has been sufficiently worn down, the opening created by the mill 10 has gotten well underway and the risk to further contact between the cutting structure, such as blades 30–34, with the guiding surface 26 of the whipstock 20 is greatly reduced. Stalling is also minimized in that the advancement of the mill initially toward the pinch point 28 is restricted by the ring 38. The ring 38 allows the motor 14 to come up to optimum speed and torque delivery while using the weight of the bottomhole assembly to keep the cutting structure away from the guiding surface 26.

Those skilled in the art will appreciate that other bottomhole assemblies can be used, and the invention is not limited to mills that are run only on coiled tubing or any specific structure for the mill used to initially cut or finish off the cutting of a window. Accordingly, the ring concept is adaptable to mills that are driven on rigid tubing to achieve the benefits of protecting the guiding surface 26 of the whipstock 20. While the preferred embodiment of the ring 38 has been illustrated as a solid ring around the body 40 of the mill 10, the structure need not be a continuous structure. All radially spacing structures which can be mounted to the body 40 to serve as a fulcrum, as illustrated in FIG. 1, are intended to be within the purview of the invention. Thus, a series of lugs around the periphery of body 40 which are wearable can also be employed. The invention is as broad as encompassing any spacing structure providing a distancing effect for the cutting structure of the mill during initial cutting which wears during the cutting to allow the mill to further progress to complete the operation.

The foregoing disclosure and description of the invention are illustrative and explanatory thereof, and various changes in the size, shape and materials, as well as in the details of the illustrated construction, may be made without departing from the spirit of the invention.

We claim:

1. An apparatus for milling a tubular member such as a casing, using a whipstock, comprising:

a mill having a body and a cutting structure;

a wearable member mounted to said body;

said wearable member regulating the angular positioning of said cutting structure with respect to the whipstock.

2. The apparatus of claim 1, wherein said wearable member initially extends radially further than said cutting structure.

3. The apparatus of claim 1, wherein said wearable member is disposed adjacent said cutting structure and acts as a fulcrum on said mill about which the cutting structure is moved away from the whipstock and toward the casing.

4. The apparatus of claim 1, wherein said wearable member prevents said cutting structure from descending toward a pinch point formed by the whipstock and the casing.

5. The apparatus of claim 1, wherein said wearable member is metallic and substantially circumscribes said body.

6. The apparatus of claim 5, wherein said wearable member is segmented around the periphery of said body.

7. The apparatus of claim 3, wherein said wearable member prevents said cutting structure from descending toward a pinch point formed by the whipstock and the casing.

8. An apparatus for milling a tubular member such as a casing, using a whipstock, comprising:

a mill having a body and a cutting structure;

a wearable member mounted to said body;

said wearable member regulating the positioning of said cutting structure with respect to the whipstock;

wherein said wearing down of said wearable member regulates the rate of advancement of the cutting structure into the casing.

9. The apparatus of claim 8, wherein said wearable member is disposed adjacent said cutting structure and acts as a fulcrum on said mill about which the cutting structure is moved away from the whipstock and toward the casing.

10. The apparatus of claim 9, wherein said wearable member prevents said cutting structure from descending toward a pinch point formed by the whipstock and the casing.

11. The apparatus of claim 10, wherein said wearable member is metallic and substantially circumscribes said body.

12. The apparatus of claim 11, wherein said wearable member is brass or bronze.

13. The apparatus of claim 12, wherein said wearable member is segmented around the periphery of said body.

14. An apparatus for milling a tubular member such as a casing, using a whipstock, comprising:

a mill having a body and a cutting structure;

a wearable member mounted to said body;

said wearable member regulating the positioning of said cutting structure with respect to the whipstock;

wherein said wearable member is metallic and substantially circumscribes said body;

wherein said wearable member is brass or bronze.

15. An apparatus for milling a tubular member such as a casing, using a whipstock, comprising:

a mill having a body and a cutting structure;

a wearable member mounted to said body;

said wearable member regulating the positioning of said cutting structure with respect to the whipstock;

wherein said wearable member initially extends radially further than said cutting structure;

wherein said wearing down of said wearable member regulates the rate of advancement of the cutting structure into the casing.

16. The apparatus of claim 15, wherein said wearable member is disposed adjacent said cutting structure and acts as a fulcrum on said mill about which the cutting structure is moved away from the whipstock and toward the casing.

17. The apparatus of claim 16, wherein said wearable member prevents said cutting structure from descending toward a pinch point formed by the whipstock and the casing.

18. The apparatus of claim 17, wherein said wearable member is metallic and substantially circumscribes said body.

19. The apparatus of claim 18, wherein said wearable member is brass or bronze.

20. The apparatus of claim 19, wherein said wearable member is segmented around the periphery of said body.

* * * * *